US009040804B2

(12) United States Patent
Dejima

(10) Patent No.: US 9,040,804 B2
(45) Date of Patent: May 26, 2015

(54) ELECTRONIC STRINGED INSTRUMENT

(71) Applicant: CASIO COMPUTER CO., LTD., Shibuya-ku, Tokyo (JP)

(72) Inventor: Tatsuya Dejima, Hamura (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/070,032

(22) Filed: Nov. 1, 2013

(65) Prior Publication Data

US 2014/0144310 A1 May 29, 2014

(30) Foreign Application Priority Data

Nov. 27, 2012 (JP) ..... 2012-258172

(51) Int. Cl.

| | |
|---|---|
| ***G10H 1/18*** | (2006.01) |
| ***G10H 1/34*** | (2006.01) |
| ***G10H 1/055*** | (2006.01) |
| ***G10H 3/12*** | (2006.01) |
| ***G10H 3/18*** | (2006.01) |

(52) U.S. Cl.

CPC . *G10H 1/18* (2013.01); *G10H 1/34* (2013.01); *G10H 1/0551* (2013.01); *G10H 3/125* (2013.01); *G10H 3/181* (2013.01)

(58) Field of Classification Search

USPC ..... 84/615, 653

See application file for complete search history.

(56) References Cited

U.S. PATENT DOCUMENTS

| | | | | | |
|---|---|---|---|---|---|
| 1,975,220 | A | * | 10/1934 | Ananiew | 84/671 |
| 2,070,344 | A | * | 2/1937 | Waters | 84/674 |
| 2,239,985 | A | * | 4/1941 | Benioff | 84/726 |
| 3,297,813 | A | * | 1/1967 | Cookerly et al. | 84/726 |
| 3,482,028 | A | * | 12/1969 | Cox et al. | 84/722 |
| 4,295,402 | A | * | 10/1981 | Deutsch et al. | 84/715 |
| 4,348,930 | A | * | 9/1982 | Chobanian et al. | 84/726 |
| 4,430,918 | A | * | 2/1984 | Meno | 84/722 |
| 4,468,997 | A | | 9/1984 | Young | |

(Continued)

FOREIGN PATENT DOCUMENTS

| | | | |
|---|---|---|---|
| JP | 59176783 | A | 10/1984 |
| JP | 63-029193 | U | 2/1988 |
| JP | 03012299 | U | 2/1991 |

OTHER PUBLICATIONS

Japanese Office Action dated Feb. 23, 2015, issued in counterpart Japanese Application No. 2012-258172.

*Primary Examiner* — David Warren

(74) *Attorney, Agent, or Firm* — Holtz, Holtz, Goodman & Chick PC

(57) ABSTRACT

An electronic stringed instrument has a bridge section attached to one end portion of each of a plurality of conductive strings; a string touch sensor detecting a pitch when the strings are respectively pressed against and conducted to a plurality of conductive metal frets; bridge saddles and insulation tubes, which insulate the strings from the bridge section; and electrically conductive tubes, serving as connection sections, respectively connected and conducted to the strings. While holding a string with a finger, the same string can be picked, and the string pushed by the finger can be pressed against the metal fret. Accordingly, the string can be operated without a sense of incongruity. Because the strings and the bridge section can be insulated even when the bridge section is formed of metal, musical sound information can be precisely and reliably detected, and a favorable musical performance can be achieved.

4 Claims, 13 Drawing Sheets

(56) References Cited

U.S. PATENT DOCUMENTS

| | | | | | |
|---|---|---|---|---|---|
| 4,635,518 | A * | 1/1987 | Meno | 84/722 |
| 4,677,419 | A * | 6/1987 | Meno | 338/296 |
| 4,748,887 | A * | 6/1988 | Marshall | 84/646 |
| 4,858,509 | A * | 8/1989 | Marshall | 84/646 |
| 4,911,053 | A * | 3/1990 | Kashio et al. | 84/725 |
| 4,953,439 | A * | 9/1990 | Newell | 84/655 |
| 7,105,731 | B1 * | 9/2006 | Riedl | 84/200 |
| 7,598,449 | B2 * | 10/2009 | Sullivan | 84/646 |
| 7,598,450 | B2 * | 10/2009 | Meeks | 84/727 |
| 8,067,683 | B2 * | 11/2011 | Meeks et al. | 84/622 |
| 2008/0028920 | A1 * | 2/2008 | Sullivan | 84/722 |
| 2014/0144310 | A1 * | 5/2014 | Dejima | 84/726 |
| 2014/0190338 | A1 * | 7/2014 | Dejima et al. | 84/735 |

* cited by examiner

ELECTRONIC STRINGED INSTRUMENT

CROSS-REFERENCE TO RELATED APPLICATION

This application is based upon and claims the benefit of priority from the prior Japanese Patent Application No. 2012-258172, filed Nov. 27, 2012, the entire contents of which are incorporated herein by reference.

BACKGROUND OF THE INVENTION

1. Field of the Invention

The present invention relates to an electronic stringed instrument such as a guitar, a mandolin, a ukulele and a shamisen (three-stringed Japanese banjo).

2. Description of the Related Art

For example, as described in Japanese Utility Model Application Laid-Open (Kokai) Publication No. 63-029193, there has been known an electronic guitar in which the main body of the guitar is constituted by a body and a neck, and a plurality of musical trigger strings are strung over the body, and fret strings whose number is equal to the number of musical trigger strings are strung over a fingerboard provided on the neck.

In such an electronic guitar, a musical trigger switch is provided for each of the plurality of musical trigger strings which are strung over the body, and a pitch-specifying switch is provided on the fingerboard of the neck on which the plurality of fret strings are strung. The musical trigger switch is configured to detect the vibration of the musical trigger strings as an electric signal.

Also, the pitch-specifying switch includes a rubber sheet which includes a plurality of fret sections along the direction where the fret strings are strung, an electrically conductive sheet provided on the lower surface of the rubber sheet, a spacer sheet provided on the lower surface of the electrically conductive sheet, and a wiring board which is provided on the lower surface of the spacer sheet and includes a plurality of contact electrodes.

Accordingly, the pitch-specifying switch is configured as follows: the fret string is pushed with a finger and thereby pushes down the rubber sheet positioned between the fret sections, whereby the rubber sheet is elastically deformed. As a result, the electrically conductive sheet is pushed down, and comes into contact with the contact electrodes of the wiring board through the opening portion of the spacer sheet. The contact of the electrically conductive sheet with the contact electrodes allows the contact electrodes to be conducted to each other, whereby the pitch in accordance with the position of the string to be pressed is outputted as an electric signal.

In such an electronic guitar, when a performer picks with fingers the plurality of musical trigger strings which are strung over the body while holding with fingers the plurality of fret strings which are strung over the fingerboard of the neck, the pitch-specifying switch on the fingerboard outputs the pitch in accordance with the position of the string to be pressed as the electric signal, and the musical trigger switch on the body outputs the string vibration of the musical trigger string as the electric signal, thereby generating musical sound with the specified pitch in accordance with the string vibration.

However, in such an electronic guitar, a musical trigger string and a fret string are separated which are formed with a consecutive string in the case of a conventional guitar because the plurality of musical trigger strings are strung over the body and whereas the plurality of fret strings are strung over the fingerboard provided on the neck. As a result, when a performer picks the musical trigger strings with the finger for performance while holding the fret strings with the fingers, the string vibration of the musical trigger strings is not transmitted to the fret strings. Accordingly, there is a problem such as a sense of incongruity during the performance.

That is, in this electronic guitar, when a performer plays the electronic guitar, the fret string held with the finger and the musical trigger string picked with another finger may become misaligned. As a result, the fret string and the musical trigger string cannot be kept on a straight line, whereby the string vibration of the musical trigger string cannot be transmitted to the fret string. Accordingly, there is a problem in that erroneous musical sound is generated, when the performer plays the electronic guitar without being aware of the misalignment of the fret string and the musical trigger string.

Also, in this electronic guitar, a performer holds with fingers the fret string which is strung over the fingerboard of the neck and whereby the rubber sheet of the pitch-specifying switch is elastically deformed and pushed down. As a result, a performer has to press the fret strings with a strong force in order to steadily hold the fret strings with the fingers. Accordingly, there is a problem such as poor operability in terms of the strings, in addition to the sense of incongruity during the performance.

Thus, in order to solve the aforementioned problems, there has been examined an electronic guitar configured as follows: a plurality of strings having conductivity are strung over the body and the neck of the guitar body in a consecutive form, without being separated into the plurality of musical trigger strings and the plurality of fret strings. A plurality of frets of the pitch-specifying switch are formed of metal. When the plurality of strings are pressed in a state where a current flows through the plurality of strings, the plurality of strings are conducted to any of the plurality of frets, and the pitch is detected.

However, in this electronic guitar, it is necessary to enhance the intensity of the entire electronic guitar because the tension of each of the plurality of strings is increased. Accordingly, it is necessary to form a bridge section, to which one end portion of each of the plurality of strings is attached, with metal having high intensity. When the bridge section is formed of metal, there is a problem in that the plurality of strings are conducted to each other, the pitch cannot correctly be detected, and the correct musical sound cannot be generated.

SUMMARY OF THE INVENTION

An object of the present invention is to provide an electronic stringed instrument that can precisely and reliably detect musical sound information without a sense of incongruity in the operation of a string.

In accordance with one aspect of the present invention, there is provided an electronic stringed instrument comprising: a body of the instrument; a plurality of strings which are strung over the body of the instrument and have electric conductivity; a bridge section which is provided on the body of the instrument and to which one end portion of each of the plurality of strings is attached; an insulation section which insulates the plurality of strings from the bridge section; a connection section which connects the plurality of strings such that the respective plurality of strings are individually conducted; and a pitch determination section which is provided in the body of the instrument, supplies an electric signal for each of the plurality of strings connected to the connection section, and determines a pitch of musical sound to be generated by detecting to which of a plurality of frets having electric conductivity the plurality of strings have been respectively conducted by being pressed thereagainst.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

First Embodiment

Hereinafter, a first embodiment in which the present invention has been applied to an electronic guitar is described with reference to FIG. 1 to FIG. 8.

Figure 1:
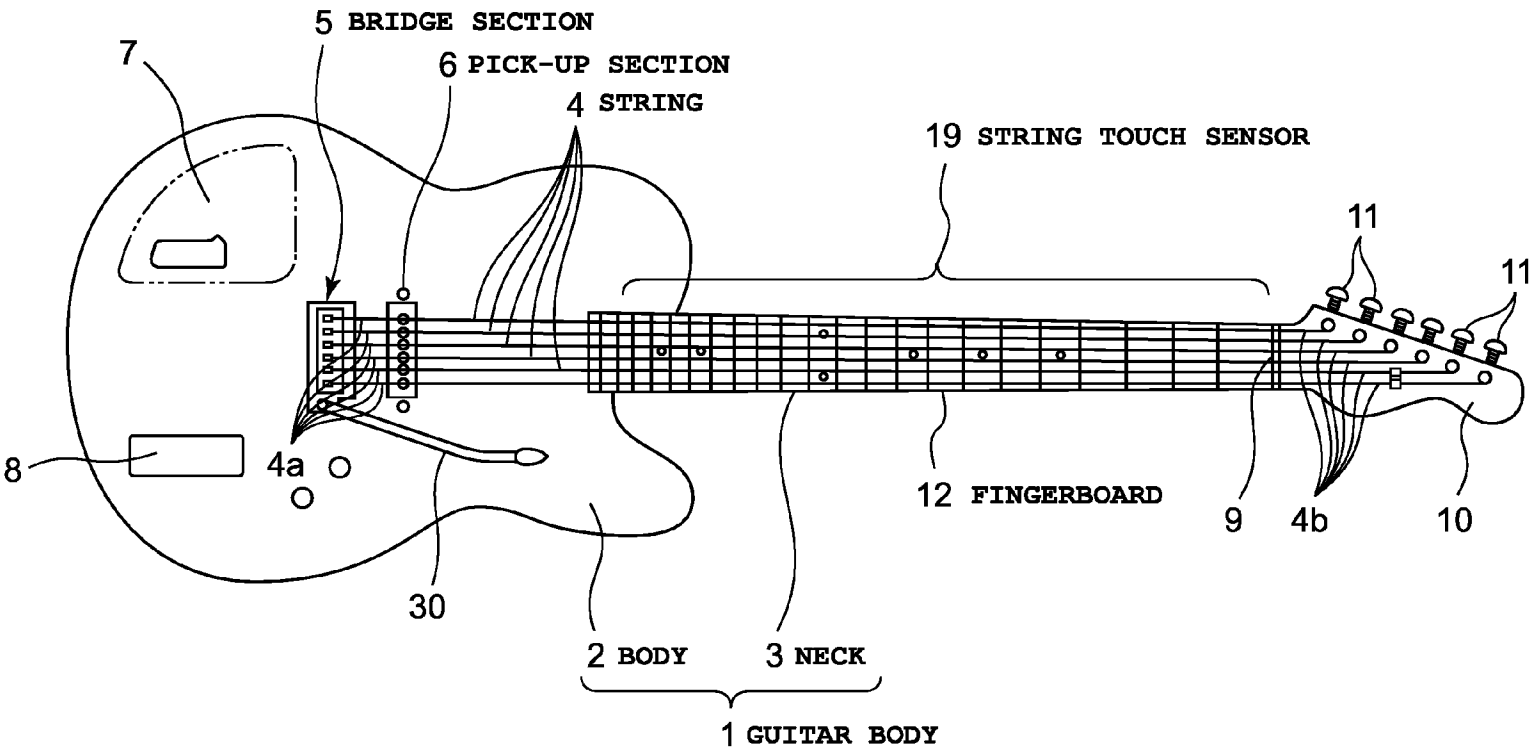
FIG. 1 is a front view illustrating a first embodiment in which the present invention is applied to an electronic guitar.

As shown in FIG. 1, the electronic guitar includes a guitar body 1. The guitar body 1 is constituted by a body 2 and a neck 3. Also, the guitar body 1 is configured such that a plurality of strings 4 (6 strings in the present embodiment) are strung over the body 2 and the neck 3.

In this case, as shown in FIG. 1, a bridge section 5 to which one end portion 4*a* of each of the plurality of strings 4 are attached is provided in the approximately central portion of the body 2. Near the bridge section 5, a pick-up section 6 is provided that detects the vibration of each of the plurality of strings 4 as an electric signal. Also, an electronic circuit section 7 and a display section 8 are provided in the body 2. The electronic circuit section 7 includes various electronic components required for the electronic guitar. The display section 8 is configured to display various information required for the performance of the electronic guitar.

On the other hand, as shown in FIG. 1, a head 10 is provided at a tip end portion (a right end portion in FIG. 1) of the neck 3 through a string support section 9. The string support section 9 is constituted such that the string support section 9 supports the plurality of strings 4 arranged at even intervals. A plurality of pegs 11 are provided on the head 10. Each of the plurality of pegs 11 enables other end portion 4*b* of each of the plurality of strings 4 to be attached such that the length of each string can be adjusted. Accordingly, the plurality of strings 4 can be strung between the bridge section 5 of the body 2 and the head 10. Each of the plurality of strings 4 is a conductive wire and has an electric resistance, whereby an electric current flows through each string.

Figure 2:
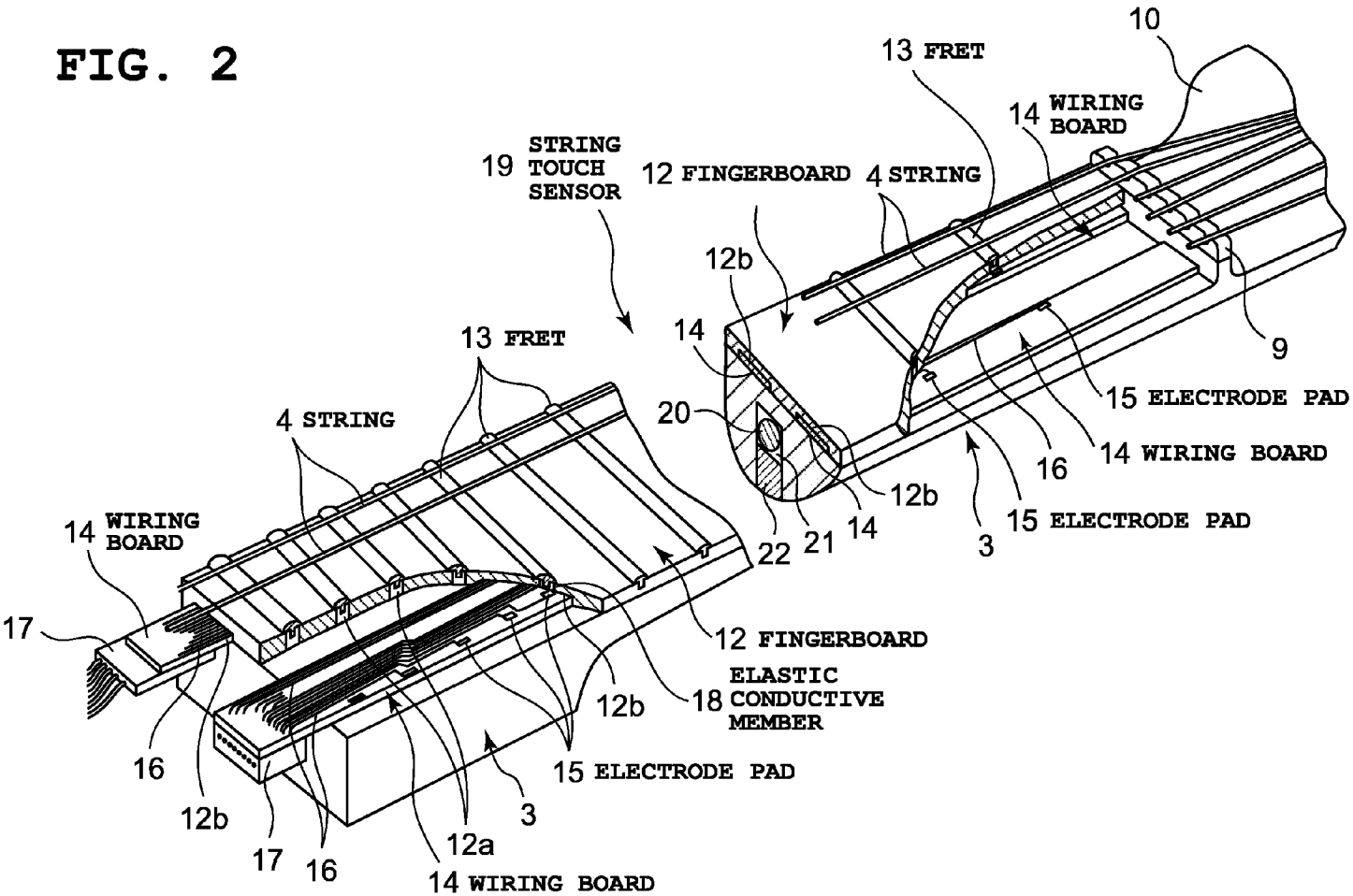
FIG. 2 is an enlarged perspective view of the main section of a neck of the electronic guitar shown in FIG. 1, which is partially broken.
Figure 3:
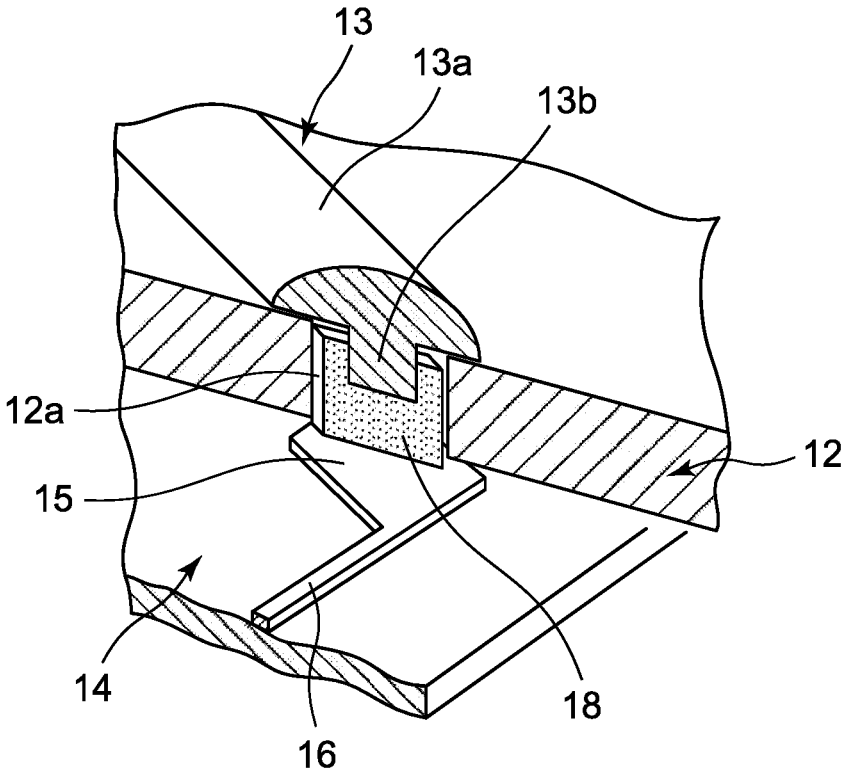
FIG. 3 is an enlarged perspective view of the main section a fingerboard shown in FIG. 2, part of which is cross-sectionally shown.

Also, as shown in FIG. 1 and FIG. 2, a fingerboard 12 is provided on the neck 3 between the body 2 and the head 10. The fingerboard 12 is a belt-shaped plate made of wood or synthetic resin. A plurality of frets 13 (22 sets in the present embodiment) are provided at predetermined intervals along with the direction where the plurality of strings 4 are strung, that is, the longitudinal direction of the neck 3. The plurality of frets 13 are respectively formed of metal with low electric resistance such as copper and nickel silver. As shown in FIG. 3, the plurality of frets 13 are respectively attached to a plurality of attaching holes 12*a* provided in the fingerboard 12.

That is, as shown in FIG. 2 and FIG. 3, the fret 13 includes a fret body portion 13*a* that is formed in a semi-cylindrical shape and a leg portion 13*b* provided on a lower surface, which is a flat surface, of the fret body portion 13*a*. The leg portion 13*b* is attached to the attaching hole 12*a* of the fingerboard 12 in a state where the leg portion 13*b* is driven into the attaching hole 12*a* and thereby is prevented from coming out of the attaching hole 12*a*. In this case, the attaching hole 12*a* of the fingerboard 12 is a slit-shaped long hole that penetrates the fingerboard 12 in a vertical direction, and is provided in the direction orthogonal to the direction where the plurality of strings 4 are strung, that is, the direction orthogonal to the longitudinal direction of the neck 3.

Accordingly, as is described in FIG. 2 and FIG. 3, the leg portion 13*b* is attached to the fingerboard 12, in a state where the leg portion 13*b* of the fret 13 is driven from above the fingerboard 12 into the attaching hole 12*a* and whereby the fret body portion 13*a* protrudes on the upper surface of the fingerboard 12. As a result, the plurality of strings 4 are respectively pressed against the upper surface, which is an arc surface, of the fret body portion 13*a*.

Also, as shown in FIG. 2 and FIG. 3, a pair of wiring boards 14 is provided between the fingerboard 12 and the neck 3. In this case, a pair of substrate storage sections 12*b* is provided in parallel along with the longitudinal direction of the neck 3 on the lower surface of the fingerboard 12. The pair of wiring boards 14 is respectively elongated and belt-shaped plate and is arranged above the neck 3, in a state where the pair of wiring boards 14 is stored in the pair of substrate storage sections 12*b* of the fingerboard 12.

Also, as shown in FIG. 2 and FIG. 3, a plurality of electrode pads 15 are provided on the upper surface of the pair of wiring boards 14 such that the plurality of electrode pads 15 corresponds to the plurality of frets 13, respectively. Also, a plurality of wiring patterns 16 are provided on the upper surface of the pair of wiring boards 14 in order that the plurality of wiring patterns 16 respectively lead the plurality of electrode pads 15 to one end portion of the wiring board 14, that is, an end portion that is positioned on the side of the body 2. The plurality of wiring patterns 16 are connected to connectors 17 provided at the end portions of the wiring boards 14, and electrically connected to the electronic circuit section 7 in the body 2 via the connectors 17.

Also, as shown in FIG. 3, a plurality of elastic conductive members 18 are provided between the plurality of frets 13 and the plurality of electrode pads 15 such that the plurality of elastic conductive members 18 electrically connect the plurality of frets 13 to the plurality of electrode pads 15, respectively. The elastic conductive members 18 are made up of rubber having conductivity, or a zebra-type interconnector in which conductive rubber and insulation rubber are alternately bonded together. As a result, the elastic conductive members 18 elastically comes in contact with the frets 13 and the electrode pads 15, thereby electrically connecting the frets 13 and the electrode pads 15.

A string touch sensor 19, which is a pitch detection section, is configured by the wiring boards 14 having the plurality of electrode pads 15, the plurality of elastic conductive members 18, the plurality of frets 13, and the plurality of strings 4. That is, as shown in FIG. 2 and FIG. 3, the string touch sensor 19 is configured such that, when the string 4 is pushed and pressed against the fret 13, the pushed string 4 and the fret 13 are electrically conducted, and the fret 13 is conducted via the elastic conductive member 18 to the electrode pad 15 of the wiring board 14.

Accordingly, as shown in FIG. 2 and FIG. 3, the string touch sensor 19 detects a pitch corresponding to the position of the string to be pressed as an electrical signal by means of the string 4 to be pressed and the electrode pad 15 corresponding to the fret 13 to which the string 4 is conducted. In this case, as shown in FIG. 2, a warping adjustment member 20 to adjust the warping of the neck 3 is provided in the interior of the neck 3. That is, a notched groove 21 is provided along with the longitudinal direction of the neck 3 and is formed to cut in from a lower portion to an inner portion of the neck 3.

The warping adjustment member 20 is attached to the neck 3 such that the both end portions of the warping adjustment member 20 can be tightened in the both portions of the neck 3 in a state where the warping adjustment member 20 is arranged in the notched groove 21 of the neck 3. Accordingly, as shown in FIG. 2, the warping adjustment member 20 is configured to adjust the warping of the neck 3 by adjusting the tightening of the both end portions thereof. Also, a lid member 22 is configured to be fitted into the lower portion of the notched groove 21. As a result, the lid member 22 can cover the notched groove 21 such that the warping adjustment member 20 is not seen from the outside.

Figure 4:
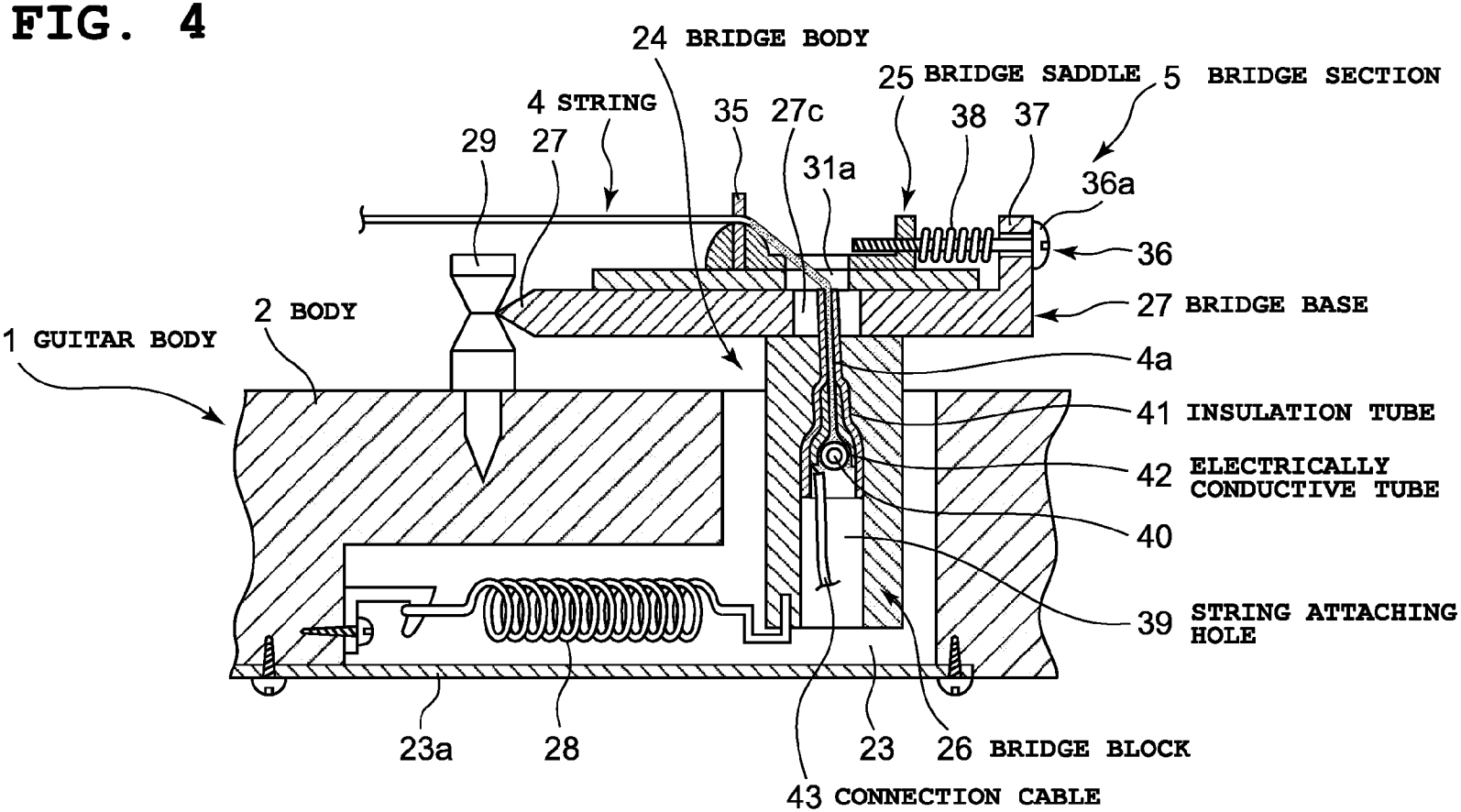
FIG. 4 is an enlarged cross-sectional view of a bridge section of the electronic guitar shown in FIG. 1.

As shown in FIG. 1 and FIG. 4, the bridge section 5, where one end portion 4*a* (left end portions in FIG. 1) of each of the plurality of strings 4 is attached, includes a bridge body 24 arranged in a bridge hole 23 provided in the central portion of the body 2, and a plurality of bridge saddles 25 arranged on the bridge body 24 with respect to the respective plurality of strings 4.

Figure 5:
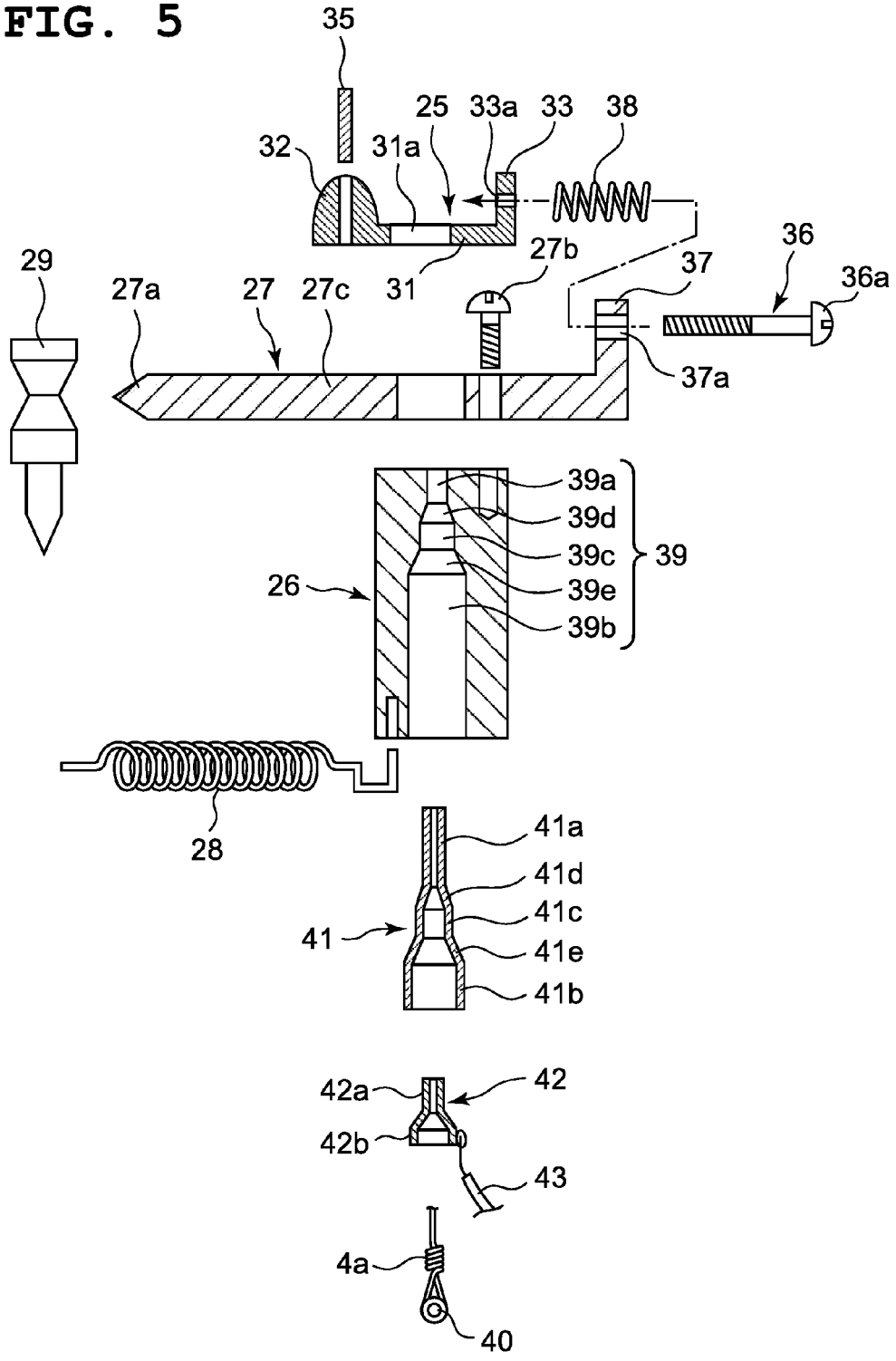
FIG. 5 is an enlarged cross-sectional view of the bridge section shown in FIG. 4, which has been exploded.

As shown in FIG. 4 and FIG. 5, the bridge body 24 includes a bridge block 26 made of metal and a bridge base 27 made of metal. It is configured such that the bridge block 26 is arranged in the bridge hole 23 of the body 2 such that the bridge block 26 protrudes upward from the body 2. Also, the bridge base 27 is attached with a screw 27*b* on the bridge block 26 that protrudes upward from the body 2.

Also, as shown in FIG. 4 and FIG. 5, a spring member 28 is attached at the lower portion of the bridge block 26, and the bridge body 24 is energized to the side of the neck 3 (left end portion in FIG. 4) by the force of the spring member 28. In this state, the tip end portion 27*a* of the bridge base 27, that is, the tip end portion 27*a* positioned on the side of the neck 3 is pressed against a pin member 29 provided on the body 2. As a result, the bridge body 24 is swingably attached in the bridge hole 23 of the body 2 in a state where the bridge block 26 floats.

In this case, as shown in FIG. 1, a tremolo arm 30 is attached in the bridge body 24. The tremolo arm 30 is configured to change the tension of the plurality of strings 4 and provide sound effects by that the tremolo arm 30 is operated such that the bridge body 24 swings in the direction where the springs 4 are strung and in the direction orthogonal to the direction where the springs 4 are strung. Note that a back lid 23*a* to cover the bridge hole 23 is provided at the lower portion of the body 2.

Figure 6:
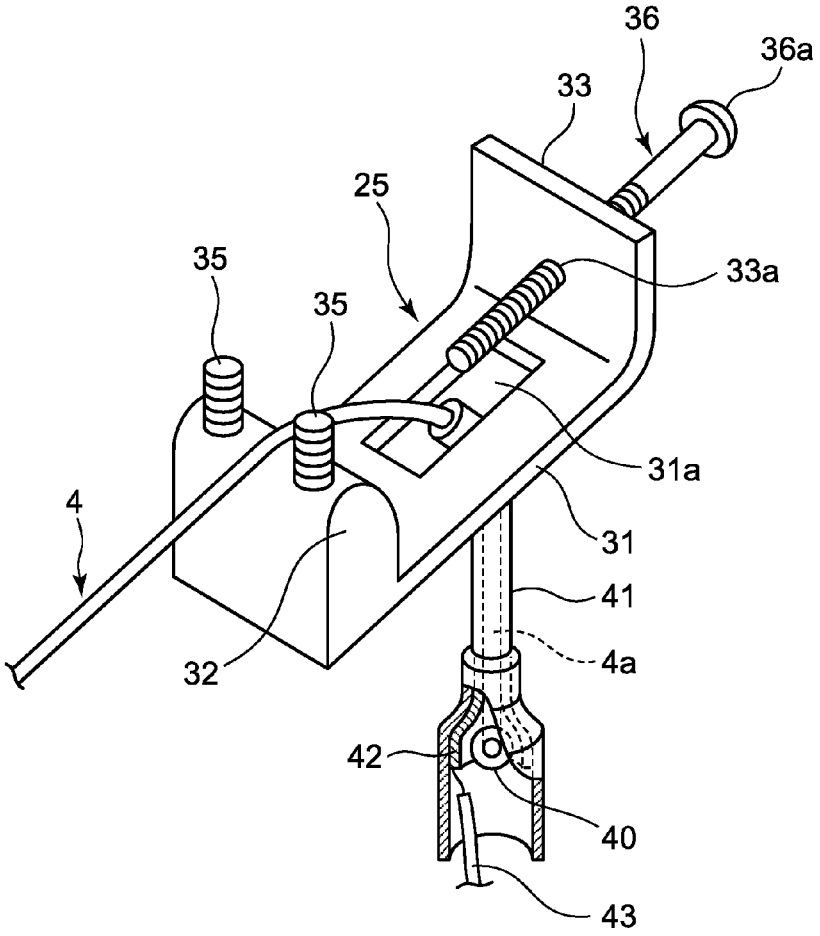
FIG. 6 is an enlarged perspective view of a bridge saddle and a string of the bridge section shown in FIG. 4, where an insulation tube of the string is partially broken.

Whereas, as shown in FIG. 4 to FIG. 6, each of the plurality of bridge saddles 25 includes a plate-shaped saddle body 31, a chevron-shaped string support section 32 provided at the front end portion (left end portion in FIG. 4) of the saddle body 31, and a plate-shaped projected portion 33 provided at the back end portion (right end portion in FIG. 4) of the saddle body 31. The plurality of bridge saddles 25 are configured to be arranged on the bridge base 27. The plurality of bridge saddles 25 are formed of synthetic resin having insulation properties, such as urea formaldehyde resin and configured such that the plurality of strings 4 are not conducted with each other.

Also, as shown in FIG. 4 to FIG. 6, a string height adjustment screw 35 is attached at the string support section 32 of the bridge saddle 25. In the present embodiment, the string height adjustment screw 35 is formed of resin and threadably engaged in a state where the string height adjustment screw 35 penetrates the string support section 32 from the upper portion to the lower portion of the string support section 32. Accordingly, when the string height adjustment screw 35 is screwed, the lower end portion of the string height adjustment screw 35 protrudes and retracts on the lower side of the bridge saddle 25, whereby the position of the bridge saddle 25 can be changed up and down on the bridge base 27 and the sound of the strings 4 can be adjusted.

Also, as shown in FIG. 4 to FIG. 6, an octave adjustment screw 36 is attached at the projected portion 33 of the bridge saddle 25. The octave adjustment screw 36 is threadably engaged with a screw hole 33*a* provided at the projected portion 33 of the bridge saddle 25 through an insertion hole 37*a* provided at an attaching portion 37 of the bridge base 27. In this case, a coil spring 38 is provided on the outer periphery of the octave adjustment screw 36 such that the coil spring 38 is positioned between the projected portion 33 of the bridge saddle 25 and the attaching portion 37 of the bridge base 27.

As shown in FIG. 4, the coil spring 38 is configured to energize the projected portion 33 of the bridge saddle 25 in the direction where the projected portion 33 is pushed out toward the front side (left side in FIG. 4), whereby the head portion 36*a* of the octave adjustment screw 36 is pushed against the external surface (right side in FIG. 4) of the attaching portion 37 of the bridge base 27. Accordingly, the projected portion 33 of the bridge saddle 25 and the attaching portion 37 of the bridge base 27 are energized by the spring force of the coil spring 38 in the direction away from each other.

Accordingly, as shown in FIG. 4, when the octave adjustment screw 36 is screwed, the head portion 36*a* rotates in a state where the head portion 36*a* abuts on the attaching portion 37 of the bridge base 27 and the screw portion at the tip spirally moves while rotating in the screw hole 33*a* of the projected portion 33 of the bridge saddle 25. As a result, the bridge saddle 25 moves in the front-and-back direction (left-and-right direction in FIG. 4) of the bridge base 27.

That is, as shown in FIG. 4, when the octave adjustment screw 36 is screwed, and the projected portion 33 of the bridge saddle 25 is pushed out toward the front side (left side in FIG. 4), the bridge saddle 25 moves on the front side by the spring force of the coil spring 38, whereby the strings 4 is adjusted to lower the octave of the strings 4.

Also, as shown in FIG. 4, when the octave adjustment screw 36 is screwed, and the projected portion 33 of the bridge saddle 25 is drawn near to the back side (right side in FIG. 4) against the spring force of the coil spring 38, the bridge saddle 25 moves on the back side, whereby the strings 4 is adjusted to raise the octave of the strings 4.

As shown in FIG. 4 to FIG. 6, the plurality of strings 4 are configured such that one end portion 4*a* of each of the plurality of strings 4 is attached in a state where the one end portion 4*a* is inserted through a string insertion hole 31*a* of the saddle body 31 of the bridge saddle 25 and a string insertion hole 27*c* of the bridge base 27, into a string attaching hole 39 of the bridge block 26.

In this case, as shown in FIG. 4 to FIG. 6, an end ball 40 having conductivity is provided at one end portion 4*a* of each of the plurality of strings 4. Also, the plurality of strings 4 is configured such that the one end portion 4*a* of each of the plurality of strings 4 is inserted into the string attaching hole 39 of the bridge block 26 via an insulation tube 41. The configuration prevents the plurality of strings 4 from coming in contact with and being conducted to the bridge block 26 and bridge base 27.

In this case, as shown in FIG. 4 and FIG. 5, the string attaching hole 39 of the bridge block 26 is constituted by a small-diameter hole 39*a* that is formed at the upper portion thereof, a large-diameter hole 39*b* that is formed at the lower portion thereof, a medium-diameter hole 39*c* that is formed at the middle portion thereof, a small-diameter tapered portion 39*d* that is arranged at the boundary between the small-diameter hole 39*a* and the medium-diameter hole 39*c* and is formed be tapered, and a large-diameter tapered portion 39*e* that is arranged at the boundary between the medium-diameter hole 39*c* and the large-diameter hole 39*b* and is formed be tapered.

The insulation tube 41 is formed of synthetic resin having insulation properties, such as polyvinyl chloride resin (PVC). As with the string attaching hole 39 of the bridge block 26, the insulation tube 41, as shown in FIG. 4 to FIG. 6, is constituted by a small-diameter hole portion 41*a* in which the string 4 is inserted, a large-diameter hole portion 41*b* in which the end ball 40 is inserted, a medium-diameter hole portion 41*c* positioned between the small-diameter hole portion 41*a* and the large-diameter hole portion 41*b*, a small-diameter tapered portion 41*d* that is arranged at the boundary between the small-diameter hole portion 41*a* and the medium-diameter hole portion 41*c* and is formed be tapered, and a large-diameter tapered portion 41*e* that is arranged at the boundary between the medium-diameter hole portion 41*c* and the large-diameter hole portion 41*b* and is formed be tapered.

Accordingly, as shown in FIG. 4 and FIG. 5, the insulation tube 41 is configured as follows: the large-diameter hole portion 41*b* is inserted into the large-diameter hole 39*b* of the string attaching hole 39 of the bridge block 26, and the large-diameter tapered portion 41*e* is abutted to the large-diameter tapered portion 39*e* of the string attaching hole 39 of the bridge block 26. Accordingly, the medium-diameter hole portion 41*c* is inserted into the medium-diameter hole 39*c* of the string attaching hole 39 of the bridge block 26, and the small-diameter tapered portion 41*d* is abutted to the small-diameter tapered portion 39*d* of the string attaching hole 39 of the bridge block 26. As a result, the small-diameter hole portion 41*a* is inserted into the small-diameter hole 39*a* of the string attaching hole 39 of the bridge block 26 and the string insertion hole 27*c* of the bridge base 27.

Also, as shown in FIG. 4 to FIG. 6, an electrically conductive tube 42 is provided in the interior of the insulation tube 41. The electrically conductive tube 42 includes a string insertion portion 42*a* in which one end portion 4*a* of the string 4 is inserted, and a wide-mouth tapered portion 42*b* provided at the lower portion of the string insertion portion 42*a*. The electrically conductive tube 42 is configured to be arranged in the insulation tube 41 in a state where the string insertion portion 42*a* is inserted into the medium-diameter hole portion 41*c* of the insulation tube 41, and the wide-mouth tapered portion 42*b* is abutted to the large-diameter tapered portion 41*e* of the insulation tube 41.

Accordingly, as shown in FIG. 4 to FIG. 6, when the end ball 40 is inserted into the large-diameter hole portion 41*b* of the insulation tube 41 in a state where the electrically conductive tube 42 is arranged in the insulation tube 41, the end ball 40 is abutted to the tapered portion 42*b* of the electrically conductive tube 42, whereby the electrically conductive tube 42 conducts to the end ball 40.

Furthermore, as shown in FIG. 5 and FIG. 6, the lower portion of the electrically conductive tube 42 is bonded to a connection cable 43 with solder or crimper. As a result, the electrically conductive tube 42 is electrically connected to the electronic circuit section 7 by means of the connection cable 43, whereby a current is supplied to the electrically conductive tube 42. Accordingly, the current supplied to the electrically conductive tubes 42 flows through the plurality of strings 4 via the end ball 40.

In this case, as shown in FIG. 4 and FIG. 5, each of the plurality of strings 4 is passed through the string attaching hole 39 of the bridge block 26, the string insertion hole 27*c* of the bridge base 27, and the string insertion hole 31*a* of the saddle body 31 of the bridge saddle 25 without contact with the bridge body 24 of bridge section 5 by mean of the insulation tube 41, and is pressed against the string support section 32 of the bridge saddles 25. As a result, the plurality of strings 4 can be sprung without conducting to each other.

Figure 7:
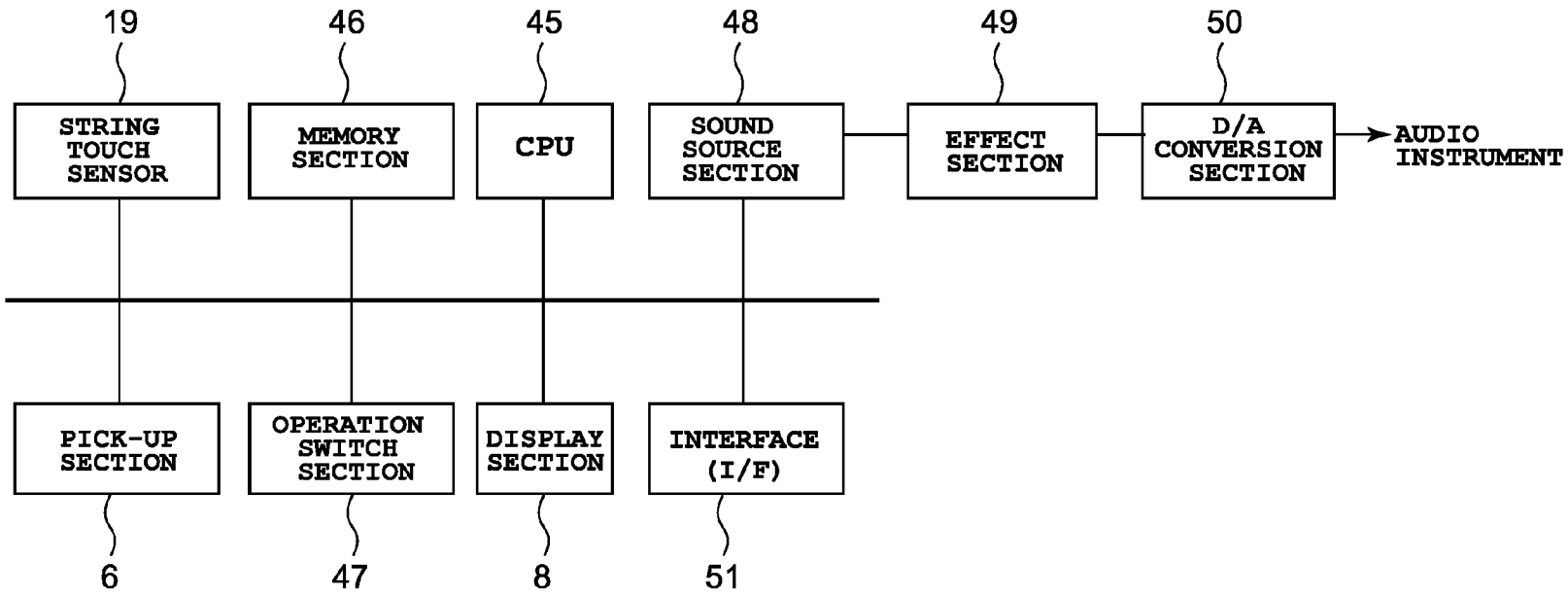
FIG. 7 is a block diagram illustrating the circuit constitution of the electronic guitar shown in FIG. 1.

Next, the circuit constitution of the electronic guitar will be described with reference to a block diagram shown in FIG. 7. In the circuit constitution of the electronic guitar, the electronic guitar includes a CPU (Central Processing Unit) 45 which controls the entire circuit; a memory section 46 which stores predetermined programs and data to be inputted; an operation switch section 47 which includes various switches with regards to sound volume, tone, and mode switching; the string touch sensor 19 which detects the positions of the plurality of strings 4 to be pressed; and the pick-up section 6 which detects the string vibration which is caused by the string operation of the plurality of strings 4, as an electric signal.

In the present embodiment, the CPU 45 determines a pitch of musical sound to be generated at the time of start of outputting the musical sound, based on the position of the string to be pressed which detected by the string touch sensor 19. Also, the CPU 45 controls the timing of outputting the musical sound and the pitch of the musical sound which is being outputted, based on the string vibration detected by the pick-up section 6.

Also, in the circuit constitution of the electronic guitar, the electronic guitar includes a display section 8 which displays various information based on the instruction from the CPU 45; a sound source section 48 which generates musical sound data based on the instructions regarding the pitch and the timing of outputting the musical sound, determined by the CPU 45; an effect section 49 which adds an effect to the musical sound data generated by the sound source section 48; a D/A conversion section 50 which converts the musical sound data, to which the effect is added by the effect section 49, into an analog signal and outputs the analog signal to an audio instrument; and an interface (I/F) 51 which transmits and receives data between the electronic guitar and external apparatuses based on the instructions from the CPU 45.

Figure 8:
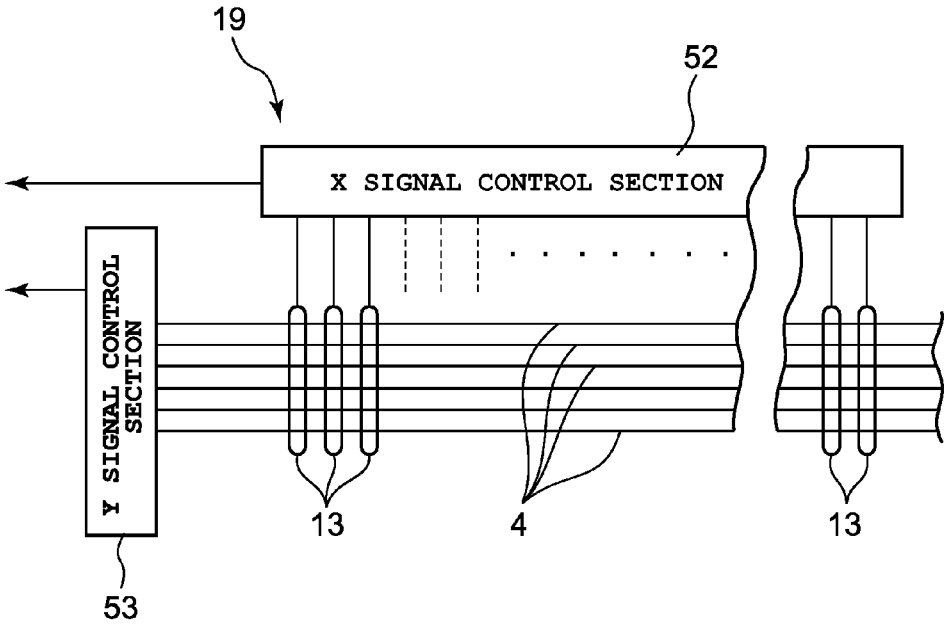
FIG. 8 is a circuit diagram illustrating a string touch sensor shown in FIG. 7.

In this case, as shown in FIG. 8, the string touch sensor 19 is configured to scan matrix switches of the X-Y coordinates, constituted by the plurality of strings 4 (six strings) and the plurality of frets 13 (22 frets), and outputs a switch signal in accordance with the position of the plurality of strings 4 to be pressed. That is, the string touch sensor 19 includes an X signal control section 52 which outputs an X coordinate signal corresponding to an X coordinate based on an output signal sequentially outputted per time division from the respective plurality of electrode pads 15 corresponding to the plurality of frets 13, and a Y signal control section 53 which outputs a Y coordinate signal corresponding to a Y coordinate based on an output signal sequentially outputted per time division from the respective plurality of strings 4.

Accordingly, when any of the plurality of strings 4 is pushed and pressed against any of the plurality of frets 13, the pressed string 4 is conducted to the fret 13, and the current flows through the string 4 and the electrode pad 15 of the wiring board 14 corresponding to the string 4. As a result, an X coordinate position of the fret 13 to which the string 4 is conducted is designated by the X signal control section 52, and a Y coordinate position of the string 4 which is conducted to the fret 13 is designated by the Y signal control section 53, whereby the X-Y coordinate positions of the pressed string 4 and the fret 13 corresponding to the string 4 are designated in the string touch sensor 19.

That is, the string touch sensor 19 is configured such that, when the X-Y coordinate positions of the pressed string 4 and the fret 13 corresponding to the string 4 are designated, the X signal control section 52 outputs a positional signal corresponding to the X coordinate of the fret 13 designated, and the Y signal control section 53 outputs a positional signal corresponding to the Y coordinate of the string 4 designated. As a result, the string touch sensor 19 detects a pitch corresponding to the position of the string to be pressed as the X-Y coordinate position and outputs the pitch.

Next, the functions of the electronic guitar will be described. When the electronic guitar is played, as with an acoustic guitar, the plurality of strings 4 strung in a tensioned state over the fingerboard 12 of the neck 3 are held with fingers. While being pressed against any of the plurality of frets 13, the string 4 corresponding to the fret 13 is picked. At this time, a pitch corresponding to the position of the string to be pressed is detected by the string touch sensor 19, and the string vibration of the pressed string 4 is detected by the pick-up section 6. As a result, the musical sound is generated based on the pitch and the string vibration.

That is, when any of the plurality of strings 4 is pushed and pressed against any of the plurality of frets 13, the string 4 is conducted to the fret 13, whereby a current flows through the string 4 and the electrode pad 15 of the wiring board 14 corresponding to the string 4. Accordingly, the X coordinate position of the fret 13 to which the string 4 is conducted is designated by the X signal control section 52, and the Y coordinate position of the string 4 which is conducted to the fret 13 is designated by the Y signal control section 53, whereby pitch information is determined in the string touch sensor 19.

Also, when the string 4 conducted to the fret 13 is picked, the pick-up section 6 detects the vibration of the picked string 4. Then, the CPU 45 instructs the sound source section 48 to generate sound source data based on the pitch information determined by the string touch sensor 19 and the string vibration information detected by the pick-up section 6, and instructs the effect section 49 to generate the musical sound data based on the sound source data, and outputs the musical sound data to the audio instrument, thereby generating the musical sound.

As described above, the electronic guitar includes the plurality of strings 4 which have conductivity and are strung in a tensioned state over the guitar body 1 which includes a body 2 and the neck 3; the bridge section 5 which is provided on the body 2 of the guitar body 1 and is attached to one end portion 4*a* of each of the plurality of strings 4; the string touch sensor 19 which is provided on the neck 3 of the guitar body 1 and detects a pitch by that the plurality of strings 4 are respectively pressed against the plurality of frets 13 made of metal and conducted to the plurality of frets 13; the bridge saddles 25 having insulation properties and the insulation tubes 41 which serve as an insulation section for insulating the plurality of strings 4 from the bridge section 5; and the electrically conductive tube 42 and the connection cables 43 which serve as a connection section for connecting such that the plurality of strings 4 are respectively conducted. As a result, musical information can steadily be detected with high accuracy and favorable performance can be achieved without a sense of incongruity in the operation of a string.

That is, in the electronic guitar, while the effective length of the string is changed by holding with a finger the string 4 that is strung over the guitar body 1, the electronic guitar can be played by picking the same string 4. Furthermore, the string 4 pushed by the finger can be pressed against the fret 13 made of metal, whereby the string operation can be performed without a sense of incongruity. Moreover, even when the bridge section 5 is formed of metal in order to enhance the intensity of the bridge section 5 attached to one end portion 4*a* of each of the plurality of strings 4, the musical information can steadily be detected with high accuracy, and favorable musical performance can be achieved.

That is, in the electronic guitar, the plurality of strings 4 can be insulated from the bridge section 5 by means of the bridge saddles 25 having insulation properties and the insulation tubes 41, which serve as an insulation section. As a result, the plurality of strings 4 can be prevented from being conducted to each other. Accordingly, the musical information can steadily be detected with high accuracy, and favorable musical performance can be achieved. Also, in the electronic guitar, reduced number of additional components can achieve the cost reduction and high-speed fret detection, that is, pitch detection.

In this case, the bridge section 5 includes the bridge body 24 in which the plurality of string attaching holes 39 are provided, such that one end portion 4*a* of each of the plurality of strings 4 is inserted and attached to each of the plurality of string attaching holes 39; and the bridge saddles 25 which are arranged with respect to the respective plurality of strings 4 on the bridge body 24 and respectively support the plurality of strings 4. Accordingly, even when the bridge body 24 is formed of metal in order to enhance the intensity of the bridge body 24 of the bridge section 5 to which one end portion 4*a* of each of the plurality of strings 4 is attached, the plurality of strings 4 can be insulated from the bridge body 24 by means of the bridge saddles 25 and the insulation tubes 41 which serve as an insulation section, whereby the plurality of strings 4 can be prevented from being conducted to each other.

That is, the insulation section includes the plurality of bridge saddles 25 having insulation properties and the plurality of insulation tubes 41. The plurality of bridge saddles 25 are respectively formed of synthetic resin having insulation properties, such as urea formaldehyde resin. The plurality of insulation tubes 41 are respectively arranged to be inserted into the plurality of string attaching holes 39 of the bridge body 24, in a state where one end portion 4*a* of each of the plurality of strings 4 is inserted into the interior of the insulation tube 41. Accordingly, even when the bridge body 24 is formed of metal, the plurality of strings 4 can be insulated from the bridge body 24 by means of the bridge saddles 25 and the insulation tubes 41, whereby the plurality of strings 4 can steadily be prevented from being conducted to each other.

In this case, the connection section includes the plurality of electrically conductive tubes 42 which are respectively provided in the interior of the plurality of insulation tubes 41 and respectively conducted to the plurality of strings 4; and the plurality of the connection cables 43 which are respectively connected to the plurality of electrically conductive tubes 42. As a result, the current can individually be supplied to the respective plurality of strings 4 by means of the plurality of the connection cables 43 via the plurality of electrically conductive tubes 42. Thus, the plurality of strings 4 can individually be pressed against the plurality of frets 13 made of metal and respectively conducted the plurality of frets 13. Accordingly, the pitch information can steadily be detected with high accuracy by means of the string touch sensor 19.

Figure 9:
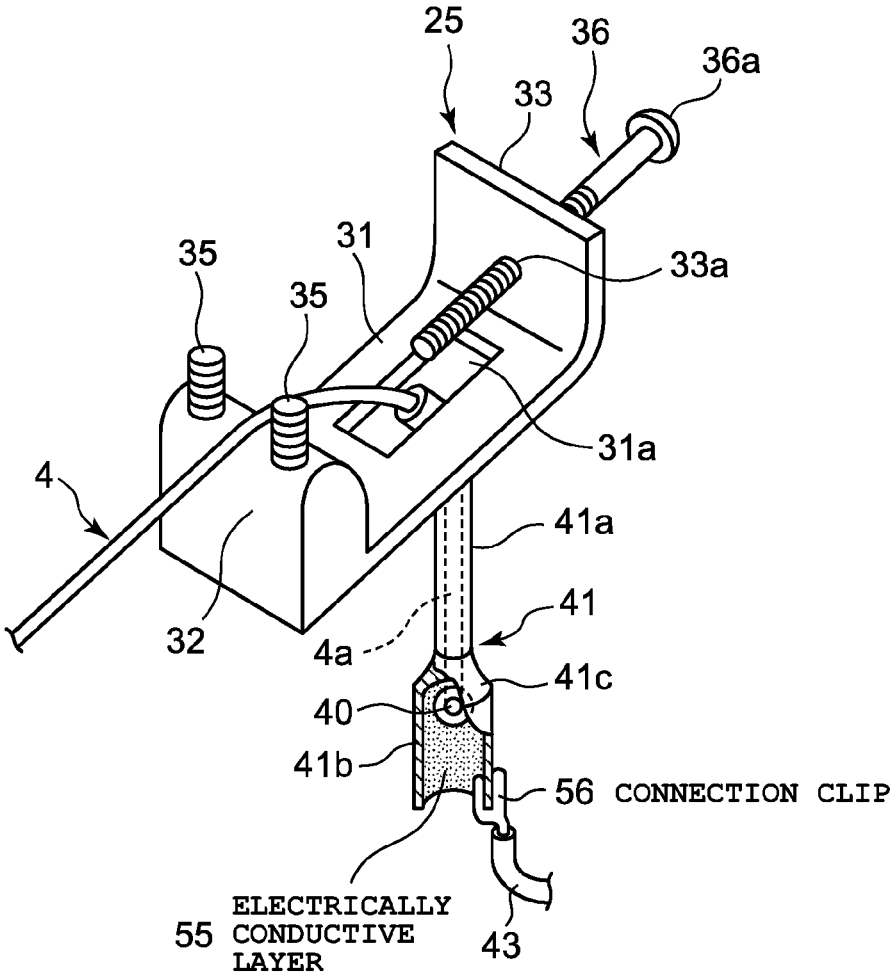
FIG. 9 is an enlarged perspective view of a variation example of a connection section in the first embodiment of the electronic guitar shown in FIG. 6, which is partially broken.

In the aforementioned first embodiment, the electrically conductive tube 42 is inserted into the insulation tube 41, and the electrically conductive tube 42 is brought into contact with the end ball 40 of the string 4 and conducted to the end ball 40, but the present invention is not limited thereto. For example, it may be configured as shown in a variation example in FIG. 9. In the configuration, an electrically conductive layer 55 is provided on the inner surface of the insulation tube 41 and abutted to the end ball 40, whereby the electrically conductive layer 55 and the end ball 40 are conducted to each other. Then, connection clips 56 are attached to the lower portion of the insulation tube 41 such that the electrically conductive layer 55 is caught between the connection clips 56. And then, the connection cable 43 is connected to the connection clips 56.

Even if such configuration is used, the electrically conductive layer 55 provided on the inner surface of the insulation tube 41 is brought into contact with the end ball 40 of the string 4, thereby being conducted to the end ball 40. As a result, the current can be supplied to the string 4 in the insulation tube 41 by means of the connection cable 43 via the electrically conductive layer 55. Thus, the respective plurality of strings 4 are individually pressed against the plurality of frets 13 made of metal and conducted to the frets 13. Accordingly, the pitch information can steadily be detected with high accuracy by means of the string touch sensor 19.

Second Embodiment

Next, a second embodiment in which the prevent invention has been applied to the electronic guitar is described with reference to FIG. 10 to FIG. 13. Sections identical to those of the first embodiment shown in FIG. 1 to FIG. 8 are provided with the same reference numerals.

Figure 10:
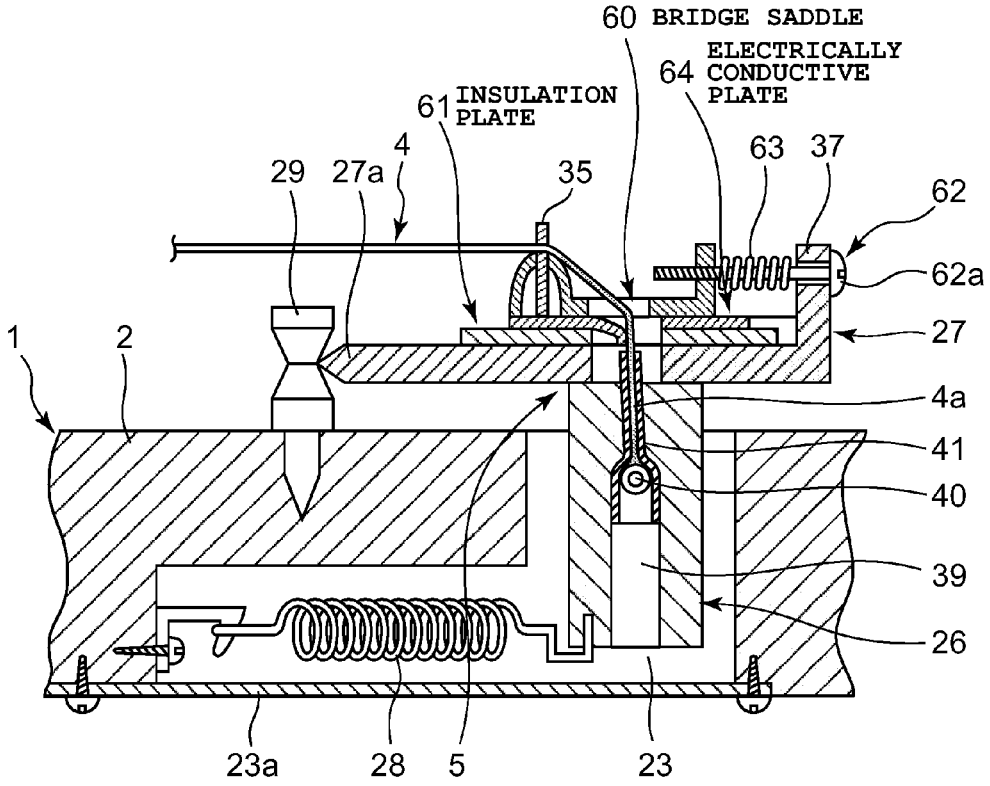
FIG. 10 is an enlarged cross-sectional view of a bridge section of an electronic guitar in a second embodiment in which the present invention is applied to the electronic guitar.
Figure 11:
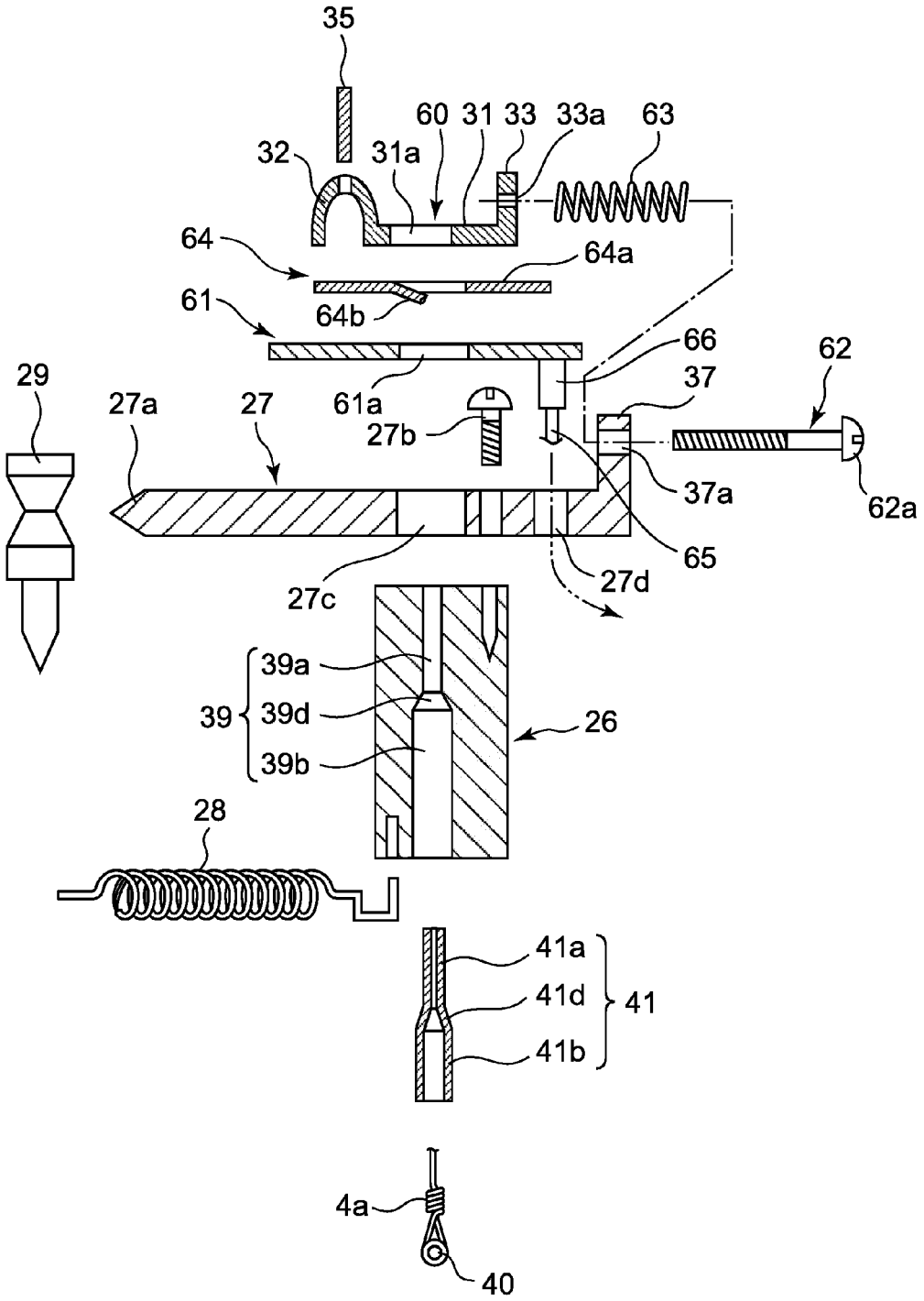
FIG. 11 is an enlarged cross-sectional view of the bridge section shown in FIG. 10, where the bridge section has been disassembled.

As shown in FIG. 10 and FIG. 11, the configuration of the electronic guitar is substantially the same as that of the first embodiment except an insulation section for insulating the plurality of strings 4 from the bridge section 5 and connection section for connecting such that the plurality of strings 4 are respectively conducted.

That is, as shown in FIG. 10 to FIG. 13, the insulation section includes an insulation plates 61 which is arranged between a plurality of bridge saddles 60 and the bridge body 24; and the insulation tubes 41 which are respectively arranged to be inserted into the plurality of string attaching holes 39 of the bridge body 24 in a state where one end portion 4*a* of each of the plurality of strings 4 is inserted. In this case, the string attaching hole 39 of the bridge body 24 is constituted by a small-diameter hole 39*a* that is formed at the upper portion thereof, a large-diameter hole 39*b* that is formed at the lower portion thereof, and a tapered portion 39*d* that is arranged at the boundary between the small-diameter hole 39*a* and a large-diameter hole 39*b*.

As with the first embodiment, the insulation tube 41 is formed of synthetic resin having insulation properties, such as polyvinyl chloride resin (PVC). As with the string attaching hole 39 of the bridge block 26, the insulation tube 41 is constituted by a small-diameter hole portion 41*a* in which the string 4 is inserted, a large-diameter hole portion 41*b* in which the end ball 40 is inserted, and a tapered portion 41*d* that is arranged at the boundary between the small-diameter hole portion 41*a* and the large-diameter hole portion 41*b*.

Figure 12:
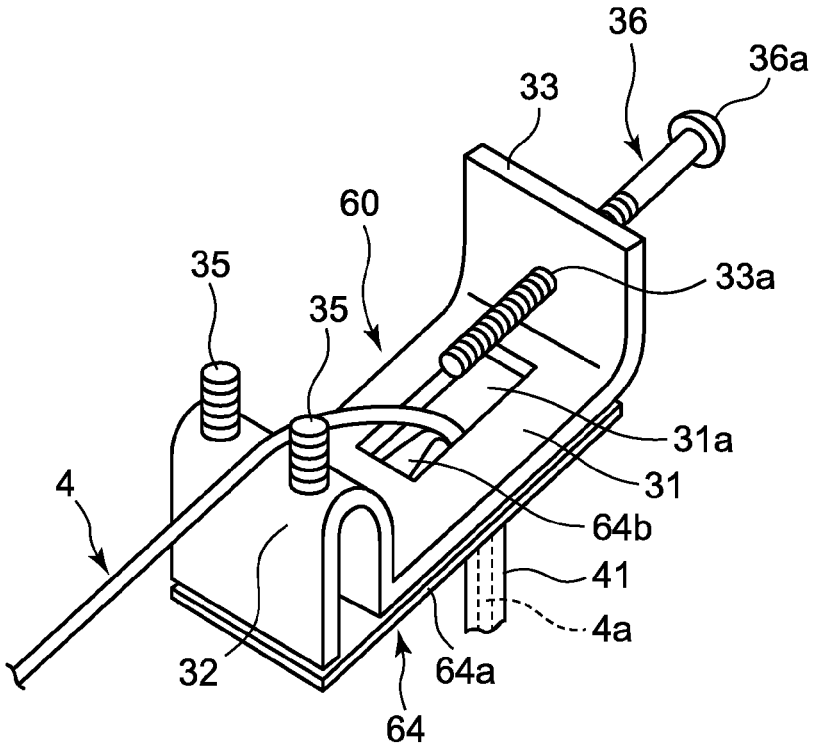
FIG. 12 is an enlarged perspective view of a bridge saddle and a string of the bridge section shown in FIG. 10.

Also, the plurality of bridge saddles 60 are formed of a metal plate to which sheet metal working is applied. Except for this, the configuration of the bridge saddles 60 is similar to that of the first embodiment. As shown in FIG. 10 to FIG. 12, each of the plurality of bridge saddles 60 includes the flat-plate-shaped saddle body 31; the string support section 32 curved in a chevron shape and provided at the front end portion (left end portion in FIG. 10) of the saddle body 31; and the plate-shaped projected portion 33 provided at the back end portion (right end portion in FIG. 10) of the saddle body 31. The plurality of bridge saddles 60 are arranged on the bridge base 27 via the insulation plate 61.

Figure 13:
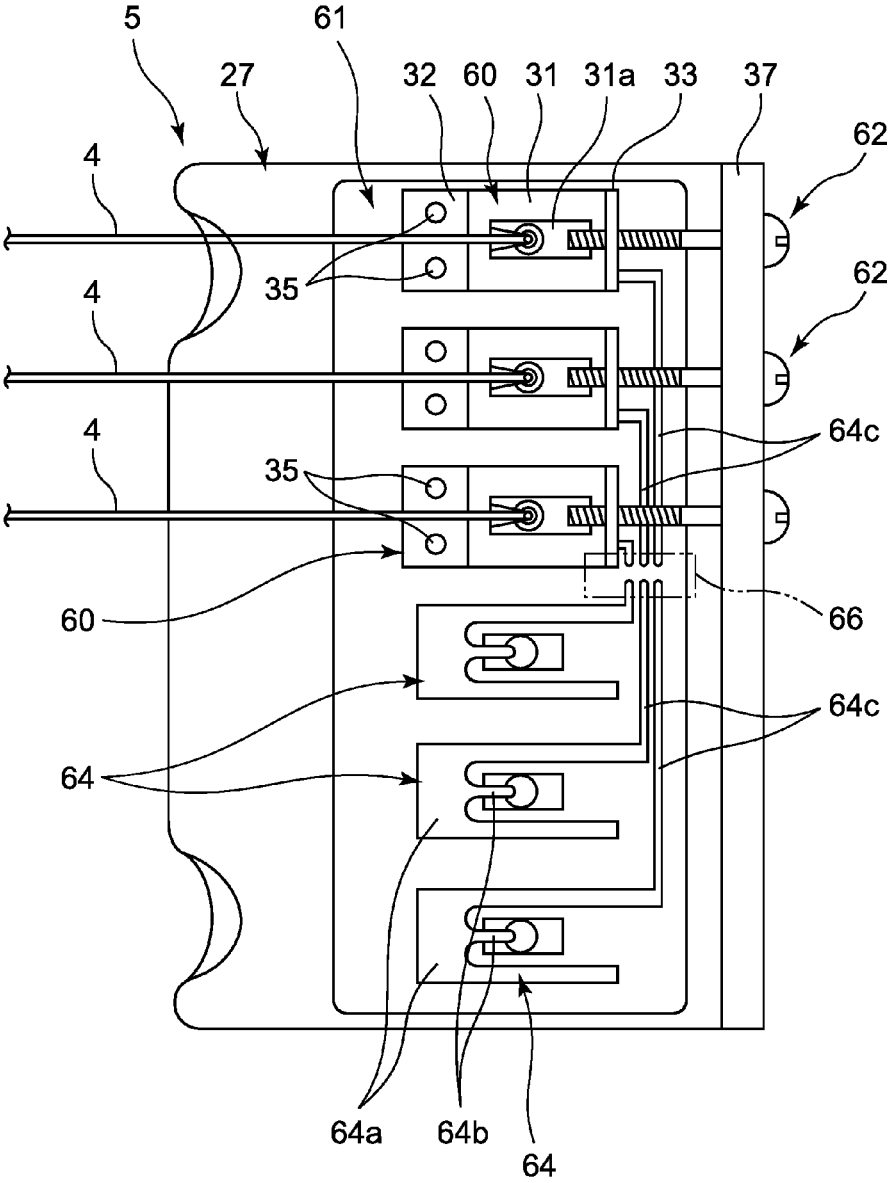
FIG. 13 is an enlarged plan view illustrating a state where part of the bridge saddle is detached, and part of an electrically conductive plate is exposed, with regards to the bridge section shown in FIG. 10.

As shown in FIG. 13, the insulation plate 61 is made up of synthetic resin having insulation properties and arranged approximately over almost the entire area of the upper surface of the bridge base 27. Also, in the first embodiment, the string height adjustment screw 35 provided at the string support section 32 of the bridge saddle 60 is formed of resin. In contrast, in the second embodiment, the string height adjustment screw 35 is formed of metal having conductivity. On the other hand, an octave adjustment screw 62 and a coil spring 63 are respectively formed of synthetic resin having insulation properties. Except for this, the configuration of the second embodiment is substantially the same as those of the first embodiment.

That is, the octave adjustment screw 62 is threadedly engaged with the screw hole 33*a* provided at the projected portion 33 of the bridge saddle 60 through the insertion hole 37*a* provided at the attaching portion 37 of the bridge base 27. Also, as shown in FIG. 10 and FIG. 11, the coil spring 63 is configured to energize the projected portion 33 of the bridge saddle 60 in the direction where the projected portion 33 is pushed out toward the front side (left side in FIG. 10), whereby the head portion 62*a* of the octave adjustment screw 62 is pushed against the external surface (right side in FIG. 10) of the attaching portion 37 of the bridge base 27.

Thus, the projected portion 33 of the bridge saddle 60 and the attaching portion 37 of the bridge base 27 are energized by the spring force of the coil spring 63 in the direction away from each other. Accordingly, as with the first embodiment, when the octave adjustment screw 62 is screwed, the head portion 62*a* rotates in a state where the head portion 62*a* abuts the attaching portion 37 of the bridge base 27 and the screw portion at the tip spirally moves while rotating in the screw hole 33*a* of the projected portion 33 of the bridge saddle 60. As a result, the bridge saddle 60 moves in the front-and-back direction (left-and-right direction in FIG. 10) of the bridge base 27.

Similarly, in this case, as shown in FIG. 10 and FIG. 11, each of the plurality of strings 4 is passed through the string attaching hole 39 of the bridge block 26, the string insertion hole 27*c* of the bridge base 27, the string insertion hole 61*a* of the insulation plate 61, and the string insertion hole 31*a* of the saddle body 31 of the bridge saddle 60 without the contact with the bridge body 24 of bridge section 5 by mean of the insulation tube 41, and is pressed against the string support section 32 of the bridge saddles 60. As a result, the plurality of strings 4 can be sprung without conducting to each other.

As shown in FIG. 10 to FIG. 13, the connection section for connecting such that the plurality of strings 4 are respectively conducted includes a plurality of electrically conductive plates 64 which are respectively arranged between the insulation plates 61 and the plurality of bridge saddles 60 and individually conducted to the plurality of strings 4; and connection cables 65 by which the plurality of electrically conductive plates 64 are electrically connected to the electronic circuit section 7. The electrically conductive plates 64 are made up of thin, metal plate having high conductivity such as copper and configured to be conducted to the bridge saddles 60 arranged on the upper surface thereof.

That is, as shown in FIG. 11 and FIG. 13, the electrically conductive plate 64 includes a body portion 64*a* with which the lower end of the string height adjustment screw 35 attached to the bridge saddle 60 comes into contact, whereby the string height adjustment screw 35 is conducted to the bridge saddle 60, and which comes into contact with the lower surface of the bridge saddle 60; a string contact portion 64*b* which protrudes in the string insertion hole 61*a* of the insulation plate 61 and which comes into contact with the string 4 inserted into the string insertion hole 61*a*; and a wiring portion 64*c* which is extended from the body portion 64*a* to a predetermined portion of the insulation plate 61, that is, a portion with which the bridge saddle 60 does not come in contact. The wiring portion 64*c* is connected to a connector 66 provided on the lower surface of the insulation plate 61.

In this case, as shown in FIG. 11 and FIG. 13, in a state where each wiring portion 64*c* of each of the plurality of electrically conductive plates 64 is connected to the connector 66, the connector 66 protrudes through an insertion hole 27*d* provided in the bridge base 27 on the lower side of the bridge base 27, and the connection cable 65 is connected to the protruded portion of the connector 66. As a result, the plurality of electrically conductive plates 64 are electrically connected to the electronic circuit section 7 by means of the connection cables 65, whereby the current is supplied, and the supplied current flows through the respective plurality of strings 4 directly or via the string height adjustment screw 35 and the bridge saddle 60.

Next, the functions of the electronic guitar will be described. When the electronic guitar is played, as with an acoustic guitar, the plurality of strings 4 strung in a tensioned state over the fingerboard 12 of the neck 3 are held with fingers. While being pressed against any of the plurality of frets 13, the string 4 corresponding to the fret 13 is picked. As a result, the electronic guitar can be played as in the first embodiment. At this time, a pitch is determined corresponding to the position of the string to be pressed is detected by the string touch sensor 19, and the string vibration of the pressed string 4 is detected by the pick-up section 6. As a result, the musical sound is generated based on the pitch and the string vibration.

That is, when any of the plurality of strings 4 is pushed and pressed against any of the plurality of frets 13, the string 4 is conducted to the fret 13, whereby current flows through the string 4 and the electrode pad 15 of the wiring board 14 corresponding to the string 4. Accordingly, the X coordinate position of the fret 13 to which the string 4 is conducted is designated by the X signal control section 52, and the Y coordinate position of the string 4 which is conducted to the fret 13 is designated by the Y signal control section 53, whereby the pitch of musical sound to be generated is determined in the string touch sensor 19.

Also, when the string 4 conducted to the fret 13 is picked, the pick-up section 6 detects the vibration of the picked string 4. Then, the CPU 45 instructs the sound source section 48 to generate sound source data based on the pitch detected by the string touch sensor 19 and the string vibration information detected by the pick-up section 6, and instructs the effect section 49 to generate the musical sound data based on the sound source data, and outputs the musical sound data to the audio instrument, thereby generating the musical sound.

As described above, the electronic guitar includes the plurality of strings 4 which have conductivity and are strung in a tensioned state over the guitar body 1 which includes a body 2 and the neck 3; the bridge section 5 which is provided on the body 2 of the guitar body 1 and is attached to one end portion 4*a* of each of the plurality of strings 4; the string touch sensor 19 which is provided on the neck 3 of the guitar body 1 and detects a pitch by that the plurality of strings 4 are respectively pressed against the plurality of frets 13 made of metal and conducted to the plurality of frets 13; the insulation plates 61 and the insulation tubes 41 which serve as an insulation section for insulating the plurality of strings 4 from the bridge section 5; and the electrically conductive plates 64 and the connection cables 65 which serve as a connection section for connecting such that the plurality of strings 4 are respectively conducted. As a result, musical information can steadily be detected with high accuracy and favorable performance can be achieved without a sense of incongruity in the operation of a string.

That is, in the electronic guitar, while the effective length of the string is changed by holding with a finger the string 4 that is strung over the guitar body 1, the electronic guitar can be played by picking the same string 4. Furthermore, the string 4 pushed by the finger can be pressed against the fret 13 made of metal, whereby the string operation can be performed without a sense of incongruity. Moreover, even when the bridge section 5 is formed of metal in order to enhance the intensity of the bridge section 5 attached to one end portion 4*a* of each of the plurality of strings 4, the musical information can steadily be detected with high accuracy, and favorable musical performance can be achieved.

That is, in the electronic guitar, the plurality of strings 4 can be insulated from the bridge section 5 by means of the insulation plates 61 and the insulation tubes 41 having insulation properties, which serve as an insulation section. As a result, the plurality of strings 4 can be prevented from being conducted to each other. Accordingly, the musical information can steadily be detected with high accuracy, and favorable musical performance can be achieved. Also, in the electronic guitar, reduced number of additional components can achieve the cost reduction and high-speed fret detection, that is, pitch detection.

In this case, the bridge section 5 includes the bridge body 24 in which the plurality of string attaching holes 39 are provided, such that one end portion 4*a* of each of the plurality of strings 4 is inserted and attached to one of the plurality of string attaching holes 39; and the bridge saddles 60 made of metal, which are arranged with respect to the respective plurality of strings 4 on the bridge body 24 and respectively support the plurality of strings 4; and the insulation plates 61 which are arranged between the bridge saddles 60 and the bridge body 24. Accordingly, even when the bridge body 24 and the bridge saddles 60 are formed of metal in order to enhance the intensity of the bridge body 24 and the bridge saddles 60 to which one end portion 4*a* of each of the plurality of strings 4 is attached, the plurality of strings 4 can be insulated from the bridge body 24 by means of the insulation plates 61 and the insulation tubes 41 which serve as the insulation section, whereby the plurality of strings 4 can be prevented from being conducted to each other.

That is, the insulation section includes the insulation plate 61 which is arranged between the bridge body 24 and the plurality of bridge saddles 60; and the insulation tubes 41 which are respectively arranged to be inserted into the plurality of string attaching holes 39 of the bridge body 24, in a state where one end portion 4*a* of each of the plurality of strings 4 is inserted. Accordingly, even when the bridge body 24 and the bridge saddles 60 are formed of metal, the plurality of strings 4 can be insulated from the bridge body 24 by means of the insulation plate 61 and the plurality of the insulation tubes 41, whereby the plurality of strings 4 can steadily be prevented from being conducted to each other.

In this case, the connection section includes the plurality of electrically conductive plates 64 which are respectively arranged between the insulation plate 61 and the plurality of bridge saddles 60 and individually conducted to the respective plurality of strings 4; and the plurality of the connection cables 65 which are respectively connected to the plurality of electrically conductive plates 64. As a result, the current can individually be supplied to the respective plurality of strings 4 by means of the plurality of the connection cables 65 via the plurality of electrically conductive plates 64 and the plurality of bridge saddles 60. Thus, the plurality of strings 4 can individually be pressed against the plurality of frets 13 made of metal and respectively conducted to the plurality of frets 13. Accordingly, the pitch information can steadily be detected with high accuracy by means of the string touch sensor 19.

In the aforementioned second embodiment, the electrically conductive plates 64 includes the string contact portion 64*b* which comes into contact with the string 4, but it is not necessary to include the string contact portion 64*b*. The electrically conductive plates 64 may be configured to merely include a body portion 64*a* with which the lower end of the string height adjustment screw 35 attached to the bridge saddle 60 comes into contact, whereby the string height adjustment screw 35 is conducted to the bridge saddle 60, and which comes into contact with and is conducted to the lower surface of the bridge saddle 60; and a wiring portion 64*c* which is extended to a predetermined portion of the insulation plate 61.

Also, according to the aforementioned first and second embodiments and the aforementioned variation example, the present invention is applied to the electronic guitar, but the present invention is not necessarily applied to the electronic guitar. For example, the present invention can widely be applied to various electronic string instruments such as an electronic mandolin, an electronic ukulele, and an electronic shamisen.

While the present invention has been described with reference to the preferred embodiments, it is intended that the invention be not limited by any of the details of the description therein but includes all the embodiments which fall within the scope of the appended claims.

What is claimed is:

1. An electronic stringed instrument comprising:

a body of the instrument;

a plurality of strings which are strung over the body of the instrument and have electric conductivity;

a bridge body in which a plurality of string attaching holes are provided such that one end portion of each of the plurality of strings is inserted and attached to a respective one of the plurality of string attaching holes;

a plurality of bridge saddles having insulation properties, the bridge saddles being respectively arranged in accordance with the plurality of strings on the bridge body, and each of the bridge saddles supporting a respective one of the plurality of strings;

a plurality of insulation tubes which are respectively inserted into the plurality of string attaching holes of the bridge body, wherein the one end portion of each of the plurality of strings is inserted into an interior of a respective one of the plurality of insulation tubes;

a plurality of electrically conductive sections each of which is (i) provided in an interior of a respective one of the plurality of insulation tubes and (ii) conducted to a respective one of the plurality of strings;

a plurality of connection cables which are respectively connected to the plurality of electrically conductive sections; and a pitch determination section which is provided in the body of the instrument, supplies an electric signal for each of the plurality of strings connected to the plurality of connection cables, and determines a pitch of musical sound to be generated by detecting to which of a plurality of frets having electric conductivity the plurality of strings have been respectively conducted by being pressed thereagainst.

2. The electronic stringed instrument according to claim 1, wherein each of the plurality of electrically conductive sections comprises an electrically conductive tube which is provided in the interior of its respective insulation tube, and is configured such that its respective string is abutted to the electrically conductive tube, whereby the electrically conductive tube conducts to its respective string.

3. The electronic stringed instrument according to claim 1, wherein each of the plurality of electrically conductive sections comprises an electrically conductive layer which is provided on an inner surface of its respective insulation tube, and is configured such that (i) the electrically conductive layer is abutted to its respective string, whereby the electrically conductive layer and its respective string are conducted to each other, and (ii) a connection clip is attached to a lower portion of its respective insulation tube such that the electrically conductive layer is contacted by the connection clip, whereby a respective one of the plurality of connection cables is connected to the connection clip.

4. An electronic stringed instrument comprising:

a body of the instrument;

a bridge body in which a plurality of string attaching holes are provided such that one end portion of each of the plurality of strings is inserted and attached to a respective one of the plurality of string attaching holes;

a plurality of bridge saddles which are respectively arranged in accordance with the plurality of strings on the bridge body and which support a respective one of the plurality of strings;

an insulation member which is arranged between the bridge body and the plurality of bridge saddles;

a plurality of insulation tubes which are respectively inserted into the plurality of string attaching holes of the bridge body, wherein the one end portion of each of the plurality of strings is inserted into an interior of a respective one of the plurality of insulation tubes;

a plurality of electrically conductive members each of which is (i) arranged between the insulation member and a respective one of the plurality of bridge saddles and (ii) individually conducted to a respective one of the plurality of strings;

a plurality of connection cables which are respectively connected to the plurality of electrically conductive members; and a pitch determination section which is provided in the body of the instrument, supplies an electric signal for each of the plurality of strings connected to the plurality of connection cables, and determines a pitch of musical sound to be generated by detecting to which of a plurality of frets having conductivity the plurality of strings are respectively pressed against and conducted.

* * * * *